US006843072B1

(12) United States Patent
Lau

(10) Patent No.: US 6,843,072 B1
(45) Date of Patent: Jan. 18, 2005

(54) EARRING ASSEMBLY

(76) Inventor: Terry T. Lau, 36 NE. First St., Suite 438, Miami, FL (US) 33132

( * ) Notice: Subject to any disclaimer, the term of this patent is extended or adjusted under 35 U.S.C. 154(b) by 0 days.

(21) Appl. No.: 10/238,095

(22) Filed: Sep. 10, 2002

(51) Int. Cl.[7] ..... A44C 19/00; A44B 21/00

(52) U.S. Cl. ..... 63/12; 24/629; 24/633; 24/643; 24/644; 24/645

(58) Field of Search ..... 24/68 J, 265 EC, 24/574.1, 629, 587.11, 633, 614–616, 650, 643–647, 662, 664; 63/3, 3.1, 3.2, 7–9, 11–13, 15–15.9, 20, 153, 11.4–11.7, 14.4–14.7

(56) References Cited

U.S. PATENT DOCUMENTS

| | | | | | |
|---|---|---|---|---|---|
| 87,072 | A | | 2/1869 | Rowland | 132/279 |
| 145,788 | A | * | 12/1873 | Cottle | 24/616 |
| 147,078 | A | * | 2/1874 | Stone | 24/574.1 |
| 208,968 | A | | 10/1878 | Dolloff | 63/12 |
| 229,276 | A | | 6/1880 | Riley et al. | 63/8 |
| 232,212 | A | * | 9/1880 | Shaw | 24/650 |
| 241,462 | A | | 10/1881 | Washburn | 63/13 |
| 248,641 | A | | 10/1881 | Etzensperger | 63/10 |
| 271,121 | A | | 1/1883 | Riley et al. | 63/12 |
| 364,140 | A | * | 5/1887 | Smitten | 63/12 |
| 371,283 | A | * | 10/1887 | Smitten | 63/12 |
| 411,509 | A | | 9/1889 | Pike | 63/12 |
| 421,433 | A | * | 2/1890 | Rees | 63/13 |
| 468,677 | A | * | 2/1892 | Maxheimer et al. | 24/616 |
| 512,835 | A | * | 1/1894 | Mann | 63/13 |
| 527,359 | A | * | 10/1894 | Bonner | 63/13 |
| 983,598 | A | * | 2/1911 | Auerbach | 63/12 |
| 1,003,696 | A | | 9/1911 | Briggs | 24/598.2 |
| 1,041,729 | A | * | 10/1912 | Bigney | 63/7 |
| 1,209,083 | A | | 12/1916 | Wagner, Jr. | 119/866 |
| 1,231,796 | A | * | 7/1917 | Shoeninger | 63/7 |
| 1,459,674 | A | * | 6/1923 | Jabner | 24/634 |
| 2,045,282 | A | | 6/1936 | Metcalf | 63/7 |
| 2,582,083 | A | * | 1/1952 | Tarter et al. | 63/15.7 |
| 2,713,863 | A | | 7/1955 | Handerson | 606/188 |
| 2,771,753 | A | | 11/1956 | Sallan | 63/15.7 |
| 3,221,514 | A | | 12/1965 | Newman | 63/15.7 |
| 3,736,770 | A | | 6/1973 | Kelrick | 63/15.7 |
| 3,995,447 | A | * | 12/1976 | Levsunov | 63/1.12 |
| 4,114,399 | A | | 9/1978 | Zur | 63/12 |
| 4,291,551 | A | | 9/1981 | Levine | 63/12 |
| 4,292,715 | A | | 10/1981 | Huddon | 24/705 |
| 4,458,392 | A | * | 7/1984 | Pogharian et al. | 24/664 |
| 4,667,379 | A | * | 5/1987 | Tsamas et al. | 24/636 |
| 4,694,664 | A | | 9/1987 | Elsener | 63/12 |
| 4,815,180 | A | | 3/1989 | Elsener | 24/616 |
| 4,924,562 | A | * | 5/1990 | Pogharian | 24/647 |
| 4,991,409 | A | | 2/1991 | Creates | 63/15.7 |
| D331,724 | S | | 12/1992 | Klein | D11/26 |
| 5,816,073 | A | | 10/1998 | Bardisbanyan | 63/12 |
| 6,125,657 | A | | 10/2000 | Esposito | 63/12 |
| 6,370,914 | B1 | * | 4/2002 | Bruner | 63/15.7 |

* cited by examiner

*Primary Examiner*—Robert J. Sandy
*Assistant Examiner*—Ruth C. Rodriguez
(74) *Attorney, Agent, or Firm*—Malloy & Malloy, P.A.

(57) ABSTRACT

An earring assembly including two movably connected earring segments and a clasp assembly structured to removably attach the earring assembly to a wearer's ear when in a closed, locked position. The clasp assembly includes a post secured to and extending outwardly from one earring segment and a movable locking arm secured to the other of the earring segments. The locked position of the clasp assembly is at least partially defined by the orientation of the locking arm into locking engagement with a portion of the post passing into the interior of the earring segment on which the locking arm is mounted.

22 Claims, 6 Drawing Sheets

EARRING ASSEMBLY

BACKGROUND OF THE INVENTION

1. Field of the Invention

This invention is directed to an earring assembly of the type removably secured to a wearer's ear by means of a post passing through the pierced earlobe. The earring assembly includes a clasp assembly structured to be selectively disposable into and out of a closed, locked position in a manner which significantly reduces the possibility of inadvertent detachment of the earring from the wearer's ear.

2. Description Of The Related Art

Various types of jewelry have been known and used as body adornments for centuries. As such, numerous attempts have been made to attach various jewelry items to the body in a safe and secured manner, so as to prevent inadvertent detachment and loss. Also of primary concern is attaching a piece of jewelry to the body of a wearer in a manner which does not detract from the intended aesthetic appearance of the item.

Particular attention has been directed to the fastening of earrings to a wearer's ear in that inadvertent detachment therefrom frequently goes unnoticed and results in the loss of the earring. Accordingly, in the development of earring clasps, two categories of fastening devices are primarily utilized. These categories include structures intended to be used on a "pierced" ear, wherein a post or like structure passes through an opening which has been pre-formed in the earlobe of the wearer. The second primary category of fastening devices include "clip-on" earrings.

In the category of earrings designed to be attached to a pierced ear, one particular style is commonly known as a "hoop" earring. While some styles of "hoop" earrings are of a single, ring or hoop like construction, there is another type of "hoop" earring structure which comprises two earring sections having substantially equal dimensions and configurations and which are movably connected to one another adjacent corresponding ends by means of a hinge or like connecting structure. With this type of hoop earring, the ends of the earring sections opposite to the hinge typically include a clasp for the removable attachment of the free ends, wherein the free ends are interconnected into a closed position or separated into a spaced apart, open position.

By way of example, FIG. 11 is representative of a hoop-type earring structure of the type mentioned above, and further, is disclosed in U.S. Pat. No. 4,694,664. This known earring structure, generally indicated as 150, comprises two, half loop earring sections 152 and 154 movably interconnected to one another by a hinge 156. The opposite or free ends of the sections 152 and 154 are selectively positionable between an interconnected or closed orientation as represented in FIG. 11 or a spaced apart, open orientation, not shown. Interconnecting the free ends of the sections 152 and 154 is accomplished by means of an attachment mechanism including a "spring pin" 158 fixedly secured at one end to section 154 and removably interconnected by frictional engagement to the section 152, by the outer most end of the spring pin 158 passing into an opening 160 formed in the free end of the section 152.

Frictional engagement and removable attachment of the free ends of the two earring sections 152 and 154 is accomplished by means of a recess 162 formed in the free end of the spring pin 158 frictionally engaging a projection 162 formed within the interior of the receiving opening 160 of the earring section 152. Important to the workings of the frictional engagement between the spring pin 158 and the earring section 152 is an inherent flexibility of the spring pin 158, due to the fact that the connection between and the separation of the recess 162 and the projection 164 is accomplished by exerting a pushing force and a pulling force, respectively, to close and open the earring structure, as set forth above. While the structure of FIG. 11 may be aesthetically pleasing, the reliability of the interconnection between the spring pin 158 and the earring section 152 is questionable due to the fact that maintaining the earring structure 150 in a closed position is entirely dependent on the frictional engagement between the recess 162 and the notch 164, which in turn is dependent on the ability of the spring pin 158 to maintain its inherent flexibility. In addition, the repeated opening and closing of this earring tends to result in a decreased performance over time in terms of being able to reliably maintain the earring securely on the ear.

FIGS. 12A and 12B are representative of another type of known earring structure 120 which incorporates a post 121 for penetrating a pierced earlobe. In addition, a clip structure 122, commonly referred to as an "omega clip" is used in combination with the post 121. The "omega clip" 122 is selectively disposed between the open position of FIG. 12A and the closed position of FIG. 12B. When in the closed position, the clip structure 122 exerts a clamping force on the earlobe of the wearer, which for many wearers can be excessive and/or which causes some discomfort to the wearer after being worn for only a short period of time.

Accordingly, there is a need in this field of art for an earring structure which assures a safe and secure attachment of the earring to a wearer's ear in a manner which does not rely entirely on a frictional type of interconnection, such as that which has been described with reference to that shown in FIG. 11. If any such earring structure were developed, it would preferably include a clasp assembly, and ideally, one having sufficient structural versatility to be used with a clip structure, wherein the clip structure and the remainder of the clasp assembly is structured to alleviate the discomfort to the wearer's earlobe due to an excessive clamping force being exerted thereon. Finally, if any such improved earring assembly were developed, it would preferably incorporate a clasp assembly which may be used with a variety of different earring styles and which does not interfere with the intended aesthetic appearance of the earring structure, regardless of its design.

SUMMARY OF THE INVENTION

The present invention is directed to an earring assembly preferably structured to be removably secured to the pierced earlobe of a wearer in a safe and secure manner through the provision of a clasp assembly. More specifically, the earring assembly preferably includes at least two earring segments movably secured to one another by a hinge or like structure and thereby selectively disposable between an open position and a closed position. When the earring segments are in the closed position, the structural and functional features of the clasp assembly significantly reduce the possibility of the earring becoming inadvertently detached from the wearer's ear. However, when desired the clasp assembly may be easily and quickly disposed in an unlocked position, thereby facilitating orientation of the earring segments in their open position so that the earring can be removed from the wearer's ear.

The size, configuration and overall structure of the earring may of course vary greatly. As such, the two earring segments may have a substantially equivalent dimension and configuration, wherein the two segments are pivotally or otherwise movably connected at corresponding ends. The opposite or "free ends" of the earring segments may be interconnected or attached by the aforementioned clasp assembly. Alternatively, the two earring segments may differ significantly in both size, configuration, structure and appearance. However, the clasp assembly includes substantially the same structural and operational features, regardless of the structural differences of the earring assembly with which it is used. Moreover, while the various preferred embodiments of the present invention may be described with primary reference to two earring segments being movably interconnected to one another, the present invention further contemplates the possibility of including more than two earring segments and/or decorative structures associated therewith.

As set forth above, one feature common to all the preferred embodiments of the present invention is the secure and safe mounting of the earring on the earlobe of a wearer by incorporating the aforementioned clasp assembly. The clasp assembly comprises a post, preferably of substantially rigid construction, secured to one of the two earring segments and extending outwardly therefrom. The post, in somewhat conventional fashion, is intended to pass through the "pierced" earlobe such that the outer or distal end of the post is free to pass into an interior of the other of the two earring segments. In order to effectively accomplish the locked position of the clasp assembly, as set forth above, a locking arm is pivotally or otherwise movably connected to or mounted on the other of the two earring segments into which the distal end of the post passes. The movable attachment of the locking arm on the corresponding earring segments allows it to be disposed into and out of locking engagement with the distal end or other portion of the post located within the interior of the other segment, when the earring assembly is in the closed position.

Cooperative structural features of both the locking arm and the post facilitate maintaining the clasp assembly in the locked position, as well as facilitate the selective orientation of the clasp assembly in the unlocked position. More specifically, the locking arm includes a post engaging portion, which in the various preferred embodiments of the present invention, may assume a variety of different structural configurations and positions relative to the post. By way of example, the post may include at least one notch formed on the portion thereof which is disposed in communicating engagement with the locking arm. At least one catch member is also disposed on the interior of the earring segment on which the locking arm is mounted.

Dependent on the preferred embodiment being utilized, the catch member may be mounted on or connected to the locking arm alternatively it may be mounted on the earring segment which receives the post therein. When mounted on the locking arm, the catch member moves therewith and can thereby be disposed into a received, locking engagement within the notch of the post. In the alternate embodiment set forth above, the notch may be fixedly secured on the interior of the corresponding earring segment. As such, the disposition of the locking arm into locking engagement with the post serves to orient and maintain the post, and specifically the notch formed therein, into receiving engagement with the fixed catch member mounted within the earring segment, independently of the locking arm.

Additional structural features associated with the clasp assembly include a locking member cooperatively disposed and structured with a portion of the locking arm so as to define a removable but secure frictional engagement there between. Interaction between the locking member and the locking arm assures that the locking arm will not be inadvertently moved out of locking engagement with the post. In addition to the locking member, a stop member may be provided in at least some of the preferred embodiments of the clasp assembly. The stop member is disposed in confronting relation to a portion of the locking arm, such that any attempt to separate the earring segments out of the closed position, without first orienting the locking arm in its unlocked position, will be prevented. The stop member, whether used independently of or in combination with the locking member, is thereby disposed and structured to retain the locking arm in locking engagement with the post.

As will explained in greater detail hereinafter, variations of the clasp assembly which are specifically defined in different preferred embodiments of the present invention include the post having a plurality of notches disposed therein. The plurality of notches are cooperatively disposed and structured to receive and engage different ones of a plurality of catch members. The plurality of catch members are also disposed on the interior of the earring segment to which the locking arm is movably connected.

More specifically, one of the plurality of catch members at least partially defines a portion of the post engaging portion of the locking arm and moves therewith into and out of engagement with a correspondingly positioned one of the plurality of notches formed in the post. Another of the plurality of catch members may be fixedly secured on the interior of the earring segment which receives the post when the two earring segments are in the closed position. This additional or second catch member is mounted independently of the locking arm and may be disposed in a generally opposing relation thereto. The second catch member is received within and lockingly engages another, correspondingly positioned notch formed in the post. In this embodiment, the orientation of the locking arm into locking engagement with the post orients and maintains the post and the corresponding notch formed therein into receiving relation with the other or second catch member fixedly secured to the respective earring segment, as set forth above. Forced or inadvertent separation of the earring segment into the open position would thereby be extremely difficult until the locking arm is selectively disposed into the unlocked position. When in the unlocked position, the post is therefore free to disengage from the fixed catch member to allow the earring segments to easily separate into the open position, facilitating removal of the earring from the wearer's earlobe.

It is further emphasized that in a most preferred embodiment of the present invention selective movement of the locking arm between the locked and unlocked positions is accomplished by the manipulation of an exterior portion thereof. The exterior portion of the locking arm extends outwardly from an interior of the earring segment to which the remainder of the locking arm is connected. The exterior portion of the locking arm is disposed in a visible, readily accessible location on the exterior of the earring segment. Also, due to adaptive modifications of the clasp assembly and/or the earring assembly, the position of the exterior portion of the locking arm, on the outside of the corresponding earring segment, may vary. Manipulation of this exterior portion thereby serves to quickly and efficiently position the locking arm into and out of either the locked or unlocked positions relative to the post.

Further, the aforementioned manual positioning of the locking arm may preferably be accomplished without the provision of any biasing spring disposed and structured to normally bias the locking arm into either the locked position or the unlocked position. However, alternate preferred embodiments of the earring assembly and in particular the clasp assembly of the present invention may incorporate a biasing structure. When utilized, the biasing structure is mounted on the earring segment common to the locking arm and is disposed in engageable and/or confronting relation therewith. The locking arm may therefore be normally biased into the locked position, as will be described in greater detailed hereinafter.

The versatility of the earring assembly and associated clasp assembly of the present invention is further demonstrated by additional preferred embodiments wherein an earlobe engaging clip may be used in combination therewith. As demonstrated in FIGS. 12 and 12A and set forth above, many conventionally structured prior art earring assemblies utilize a loop-type clip, sometimes commonly referred to as an "omega clip". However, disadvantages and problems associated with the use of the prior art, omega clips involve the clamping force exerted on the earlobe when positioned between the clip and the outer most earring segment. Typically, the clip is secured by a spring biased or other type of connection which frequently exerts undo pressure on the earlobe, thereby by causing significant discomfort to the wearer. Importantly, problems and disadvantages associated with prior art structures of the type shown in FIGS. 12 and 12A are overcome by incorporating a clip structure somewhat similar to, but clearly distinguishable from, the prior art omega clip, with the clasp assembly of the present invention. As such, the clip structure may be disposed in a predetermined "lobe engaging position", wherein the positioning of the clip structure and accordingly the pressure exerted on the earlobe is adjustable and variable. Any discomfort to the user is thereby eliminated.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying Figures, the present invention is directed to an earring assembly 10 including a clasp assembly generally indicated as 12. The clasp assembly is structured to reliably establish and maintain a locked position, thereby assuring that the earring assembly 10 will be maintained in a closed position, safely secured to the earlobe of a wearer (not shown). The earring assembly 10 of the present invention thereby overcomes many of the disadvantages and problems associated with conventional and known earring structures, such as those depicted in FIGS. 11, 12A and 12B, discussed in further detail herein.

Figure 1A:
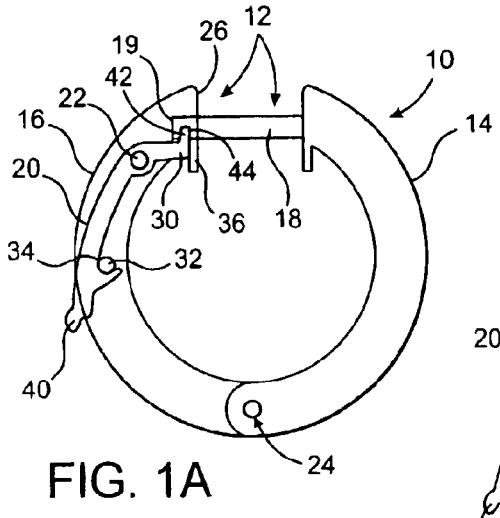
FIG. 1A is a schematic representation of one preferred embodiment of the earring assembly of the present invention disposed in a closed position.
Figure 1B:
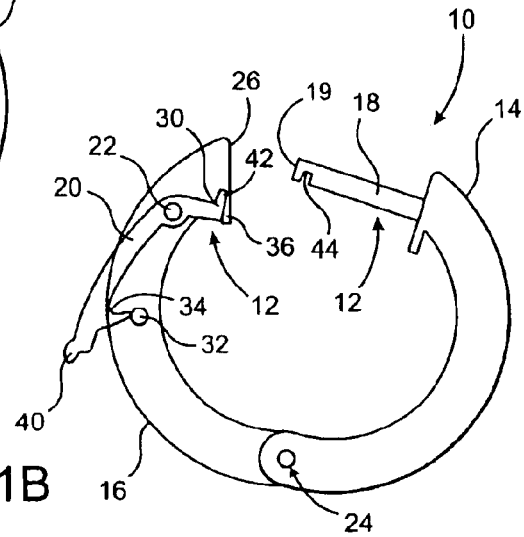
FIG. 1B is a schematic representation of the preferred embodiment of FIG. 1A, with the earring assembly disposed in an open position.

With reference now to FIGS. 1A and 1B, there is shown one preferred embodiment of the earring assembly 10 according to the present invention. In this embodiment, the clasp assembly 12 comprises a post 18 having one end secured to one of the plurality of earring segments, such as 14, and extending outwardly therefrom. The clasp assembly 12 also includes a locking arm 20 pivotally or otherwise movably connected to the other of the two earring segments, such as 16, by means of a mounting structure 22. As will be explained in greater detail hereinafter, the size, configuration and positioning of the locking arm 20 may vary dependent on the preferred operational nature of the clasp assembly 12, as well as the size, configuration and overall structure of the earring assembly 10 with which the clasp assembly 12 is used.

While the structural features of the earring assembly 10 disclosed in FIGS. 1A, 1B through 9A, 9B comprise two earring segments, 14 and 16 of substantially equal dimension and configuration, the clasp assembly 12 can be used with earring assemblies having a variety of different structures, which may include a plurality of earring segments having different sizes, configurations, overall structures and/or decoration. Further, the movable interconnection of the earring segments 14 and 16 by a hinge or pivot structure 24 is intended to be representative of a variety of different connecting assemblies which facilitate movement of the earring segments 14 and 16 relative to one another.

Still referring to the embodiment illustrated in FIGS. 1A and 1B, the earring segments 14 and 16 are disposable between the closed position of FIG. 1A and the open position of FIG. 1B. The closed position is assumed when it is intended to secure the earring assembly 10 onto the ear lobe of the wearer. In doing so, the post 18 passes through the hole of the pierced earlobe and extends at least partially into the interior of the other earring segment 16 through an at least partially open end 26. While the precise portion of the post 18 extending into the interior of the earring segment 16 may vary, at least the distal end 19 thereof is disposed therein to a sufficient degree that a locking arm 20 may be disposed in locking engagement therewith.

Accordingly, in at least some of the preferred embodiments of the clasp assembly of the present invention, the locking arm 20 includes a post engaging portion 30. For example, when it is intended to maintain the earring segments 14 and 16 in the closed position, as shown in FIG. 1A, the locking arm 20 is selectively disposed or oriented such that the post engaging portion 30 is disposed in locking engagement with a portion of the post 18 located on the interior of the earring segment 16. As shown, the locking arm 20 is disposed in locking engagement with the distal end 19 or a portion of the post 18 substantially adjacent thereto.

Figure 11:
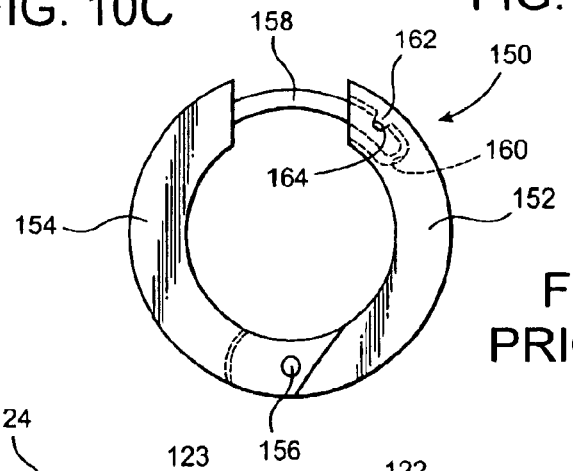
FIG. 11 PRIOR ART
FIG. 11 is a front view of an earring assembly representative of the prior art and depicting a closed position.

The orientation of the locking arm 20 into locking engagement with the post 18 significantly limits the possibility of the earring segments 14 and 16 being inadvertently separated into the open position. Consequently, chances of the earring assembly 10 being lost by becoming inadvertently detached from the ear of the wearer is significantly reduced. The disadvantages and problems associated with known earring structures, such as the type disclosed in FIG. 11, are thereby overcome.

In order to reliably assure that the locking arm 20 is maintained in locking engagement with the post 18, additional structural features of the clasp assembly preferably include a locking member 32. Ideally, the locking member 32 is fixedly secured to the other earring segment 16 in a location so as to removably, but frictionally and securely engage a predetermined portion of the locking arm 20. For example, and as shown in FIG. 1A, the locking arm 20 may include a cooperatively shaped recess 34 and in this embodiment the recess 34 is disposed to at least partially capture, and thereby, removably engage the locking member 32 when the locking arm 20 is in the closed position. When it is desired to remove the earring assembly 10 and dispose the earring segments 14 and 16 in a separated, open position such as is shown in FIG. 1B, the locking arm 20 is easily disposed in an orientation which disengages the locking member 32 from the capturing recess 34. As such, the locking arm 20 is moved into an unlocked position as demonstrated in FIG. 1B.

Other structural features of the clasp assembly included in at least one preferred embodiment of the present invention comprise a stop member 36. As shown in FIG. 1A, the stop member 36 is disposed in confronting relation to the outer most extremity of the post engaging portion 30 of the locking arm 20. Positioning and structuring of the stop member 36 in the manner disclosed prevents inadvertent displacement of the locking arm 20 out of its locked position, and concurrently, reduces the possibility of the locking arm 20 and the post engaging portion 30 being removed from locking engagement with the interior portion of the post 18. As shown in FIG. 1B, the stop member 36 is disposed and structured to allow movement of the locking arm 20 into its unlocked position and may be disposed in frictional engagement with the aforementioned extremity of the post engaging portion 30 as the locking arm moves into the unlocked position.

In order to accomplish the intended purpose of the various preferred embodiments of the earring assembly 10 and its associated clasp assembly 12, the positioning of the locking arm 20 into and out of the locked position relative to the post 18 is important. Accordingly, another preferred structural feature of the locking arm 20 comprises the provision of at least one portion 40 disposable on the interior of the earring assembly 10, but also, at least somewhat on the exterior of the earring segment 16 to which the locking arm 20 is movably connected. As will be explained with reference to other embodiments of the present invention, the exterior portion 40 of the locking arm 20 may assume a variety of different configurations, and also, may be disposed in a variety of different locations on the exterior of the earring segment 16. However, in each of the preferred embodiments of the present invention, the exterior portion 40 is at least somewhat visible, and further, is in general readily accessible so as to facilitate positioning of the locking arm 20 in either of the locked or unlocked positions.

In order to facilitate maintenance of the clasp assembly 12 in the locked position, the clasp assembly may further include at least one catch member and at least one notch both disposed on the interior of the earring segment 16 to which the locking arm 20 is movably connected. More specifically, in the embodiments of FIGS. 1A and 1B, the at least one catch member 42 is mounted on the locking arm 20 in direct association with the post engaging portion 30. As such, the catch member 42 is movable with the locking arm 20 as it is oriented into and out of its locked position. Cooperative structuring of the post 18 includes the at least one notch 44 formed thereon preferably, but not necessarily, adjacent the distal end 19 thereof. In any event, the notch 44 is formed on a portion of the post 18 which is disposed within the interior of the earring segment 16, as clearly demonstrated in FIG. 1A.

Figure 2A:
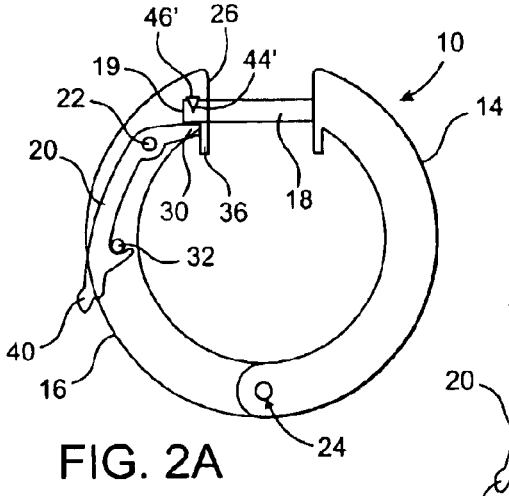
FIG. 2A is a schematic representation of yet another preferred embodiment of the earring assembly of the present invention in a closed position.
Figure 2B:
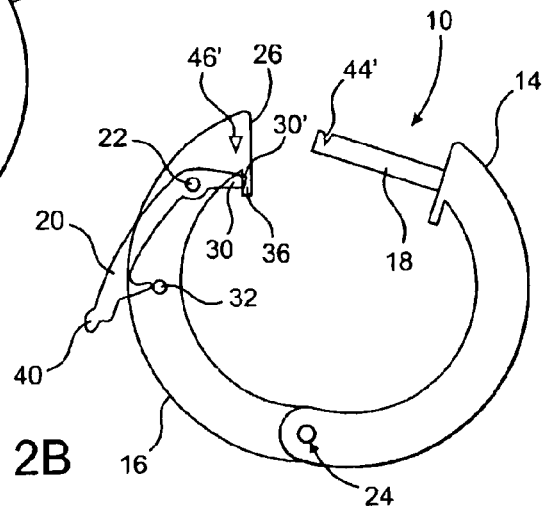
FIG. 2B is a schematic representation of the embodiment of FIG. 2A with the earring assembly illustrated in an open position.

Yet another embodiment of the present invention is disclosed in FIGS. 2A and 2B and includes the at least one notch 44' formed in the post 18 in a different location from that of the embodiment of FIGS. 1A and 1B. Similarly, the at least one catch member 46' in this embodiment is fixedly secured to the earring segment 16, preferably on the interior thereof, rather than being connected to or mounted on the locking arm 20. Accordingly, when the locking arm 20 is disposed in the locked position of FIG. 2A, the post engaging portion 30 is disposed in locking engagement with the post 18 substantially adjacent the distal end 19 and at a location substantially opposed to the cooperatively disposed recess 44' and catch member 46'. Therefore, another feature of the embodiment of FIGS. 2A and 2B is the orientation and maintenance of the post 18 and the notch 44' into a position which assures receiving engagement of the catch member 46' into the recess 44'. Accordingly, the post engaging portion 30 includes a flat or land area 30' (see FIG. 2B) to facilitate the locking engagement with a portion of the post 18 substantially opposed to the catch member 46'. Further, a distal end of the post 18 or other interior portion thereof generally adjacent to the distal end 19 is effectively "sandwiched" between the catch member 46' disposed within the recess 44' and the post engaging portion 30, 30' of the locking arm 20.

Figure 3A:
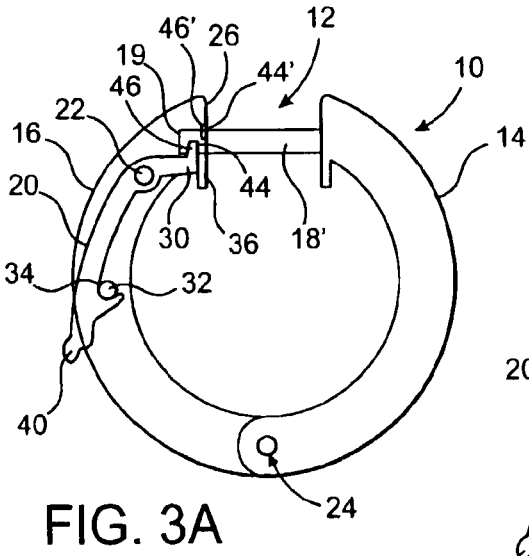
FIG. 3A is a schematic representation of yet another embodiment of the earring assembly of the present invention illustrating a closed position.
Figure 3B:
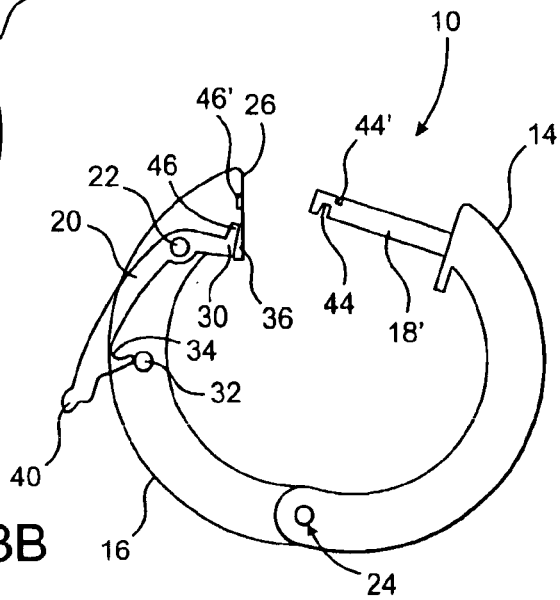
FIG. 3B is a schematic representation of the embodiment of the earring assembly of FIG. 3A illustrated in an open position.

Yet another preferred embodiment of the present invention includes the earring assembly 10 having a clasp assembly 12 which, to a certain extent, includes structural features associated with both the embodiments of FIGS. 1A, 1B, and 2A, 2B. More specifically, the clasp assembly 12 of the embodiment of FIGS. 3A and 3B includes a plurality of notches 44 and 44' formed in the post 18' on opposite sides thereof and in somewhat opposing relation to one another. In addition, the clasp assembly 12 includes a plurality of catch members 46 and 46' disposed and structured to be received within the respective notches 44 and 44'. As further disclosed in the embodiments of FIGS. 3A and 3B, one of the plurality of catch members 46 is mounted on the locking arm 20 in association with the engaging portion 30. As such, the one notch member 46 is movable with the locking arm 20 and is disposed into and out of the notch 44 as the locking arm 20 is disposed into and out of the locked position, as shown in FIG. 3A.

Similar to the embodiment of FIGS. 2A and 2B, the other of the plurality of catch members 46' is fixedly secured on the earring segment 16 so as to be received within the notch 44'. Therefore, when the locking arm 20 is disposed into the locked position of FIG. 3A, the catch member 46 is received within the notch 44. This positioning of the locking arm 20 also serves to orient and maintain the post 18' into a position such that the notch 44' receives and engages the other catch member 46' therein. Further, the interior portion of the post 18' adjacent to or directly associated with the distal end 19 is effectively captured, by being sandwiched between the catch members 46 and 46'. In addition, the provision of the stop member 36 as discussed above facilitates maintenance of the locking arm 20 in the locked position thereby further assuring that the post 18' will not become inadvertently displaced from the locked position shown in FIG. 3A.

Figure 4A:
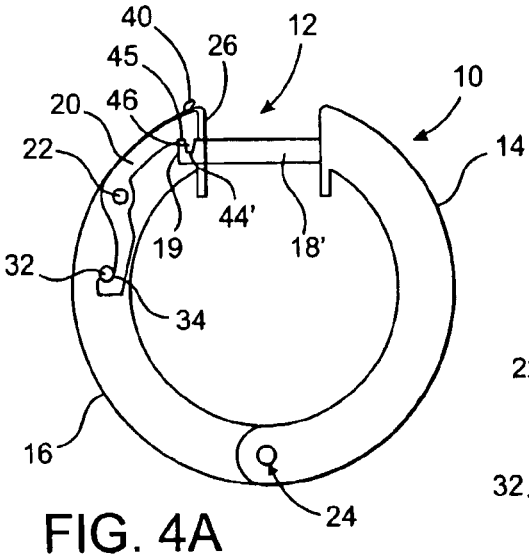
FIG. 4A is a schematic representation of yet another embodiment of the earring assembly of the present invention illustrating a closed position.
Figure 4B:
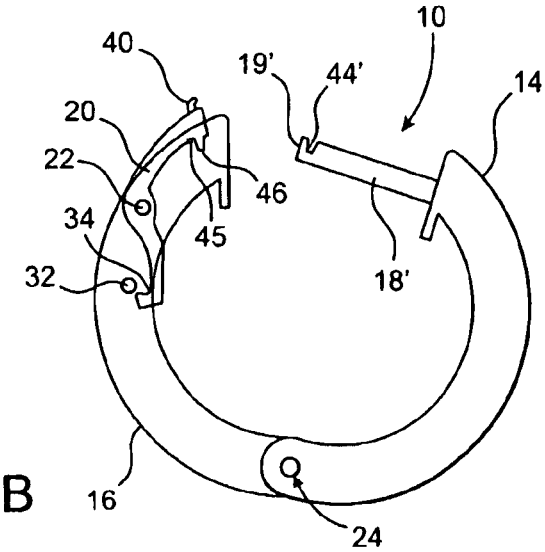
FIG. 4B is a schematic representation of the earring assembly of the embodiment of FIG. 4A illustrating an open position.

FIGS. 4A and 4B illustrate yet another embodiment of the clasp assembly 12 comprising the inclusion of at least one catch member 46 mounted on the locking arm 20 and movable therewith. In addition, the clasp assembly 12 includes a plurality of notches, at least one of which is formed on the post 18 as at 44'. Preferably, another notch 45 is disposed on the locking arm 20 immediately adjacent the one catch member 46. Disposition of the locking arm 20 in the closed position of FIG. 4A serves to dispose the one catch member 46 into receiving engagement with the notch 44' concurrently to the distal end 19' being recevingly engaged within the notch 45 formed in the locking arm 20.

Figure 5A:
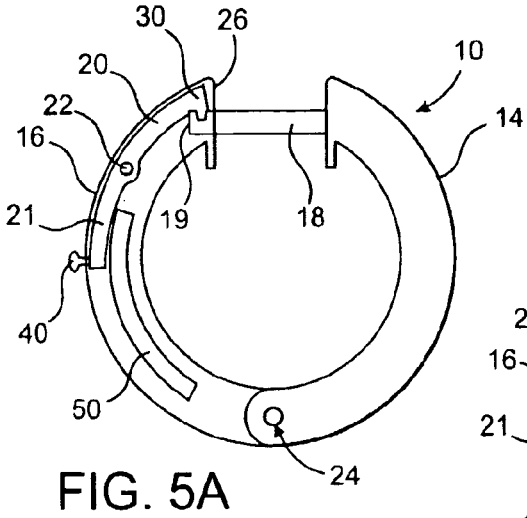
FIG. 5A is a schematic representation of yet another embodiment of an earring assembly of the present invention illustrated in a closed position.
Figure 5B:
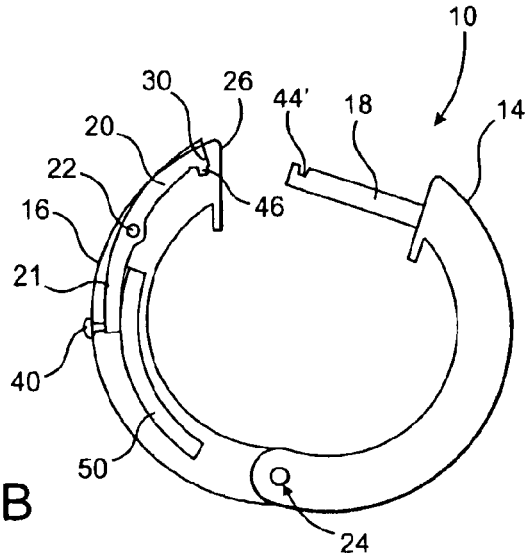
FIG. 5B is a schematic representation of the earring assembly of the embodiment of FIG. 5A in an open position.

As set forth above, the most preferred embodiment of the earring assembly 10 and clasp assembly 12 is structured to selectively and manually position the locking arm 20 into both the locked and unlocked positions, as set forth above with reference to FIGS. 1A, 1B through 4A, 4B. However, additional embodiments of the clasp assembly 12, as shown in FIGS. 5A, 5B and 6A, 6B include the provision of a biasing structure that is preferably, but not necessarily, in the form of a leaf spring 50. The leaf spring 50 is mounted on the interior of the earring segment 16 and disposed to normally bias, or at least partially maintain, the locking arm 20 in the locked position disclosed in FIGS. 5A and 5B. Accordingly, leaf spring 50 is disposed into a biasing relation with a portion of the locking arm 20 as at 21. Therefore, selective movement of the locking arm 20 out of the locked position of FIG. 5A is accomplished by a depression or other force exerted on the exterior portion 40 of the locking arm 20 against the biasing force exerted on the locking arm portion 21. This will orient the post engaging portion 30 out of locking engagement with the distal end 19 or other adjacent portion of the post 18 disposed on the interior of the earring segment 16. The earring segments 14 and 16 will thereby be allowed to separate into the open position of FIG. 5B.

Figure 6A:
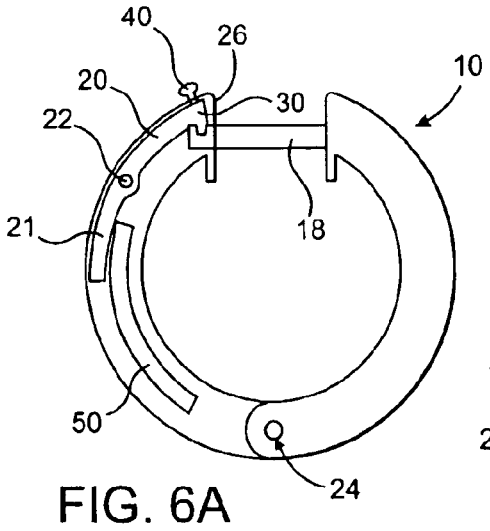
FIG. 6A is a schematic representation of yet another embodiment of an earring assembly according to the present invention and illustrating a closed position.
Figure 6B:
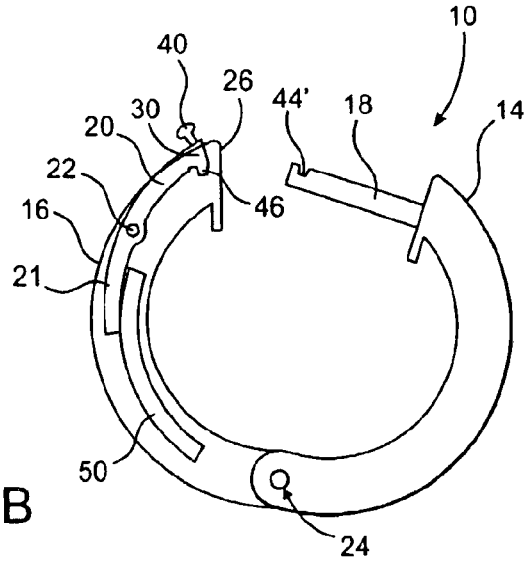
FIG. 6B is a schematic representation of the earring assembly of the embodiment of FIG. 6A and illustrating an open position.

The embodiment of FIGS. 6A and 6B is similarly structured, at least with regard to the placement and operation of the biasing spring 50. However, positioning of the locking arm 20 out of the locked position of FIG. 6A is accomplished by exerting a pulling or lifting force on the exterior portion 40 due to its location substantially adjacent the post engaging portion 30 of the locking lever 20.

Figure 7A:
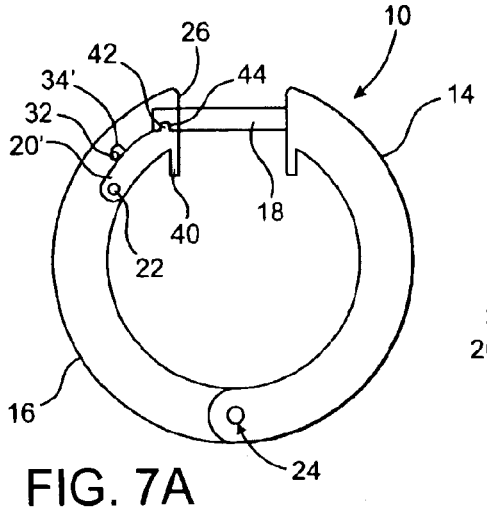
FIG. 7A is yet another embodiment of the earring assembly of the present invention illustrating a closed position.
Figure 7B:
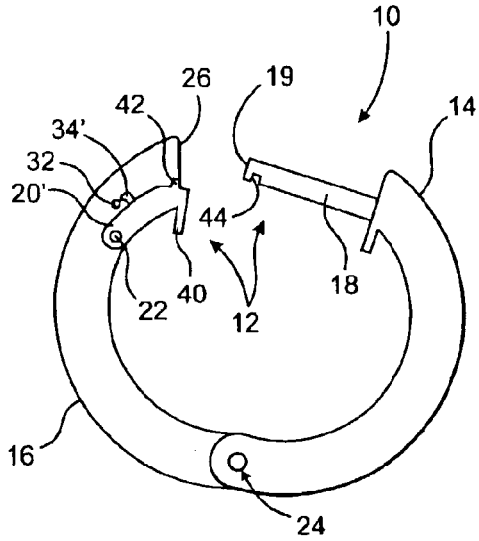
FIG. 7B is a schematic representation of the earring assembly of the embodiment of FIG. 7A illustrating an open position.

The embodiment of the earring assembly 10 as shown in FIGS. 7A and 7B includes a clasp assembly 12 having a locking arm 20' pivotally or otherwise movably connected to the earring segment 16, as at 22. A locking member 32 is fixedly secured to the earring segment 16 so as to removably and frictionally a engage a recess 34' formed in an outwardly protruding finger or portion of the locking arm 20'. Selective orientation of the locking arm 20' between the locked position of FIG. 7A and the unlocked position of FIG. 7B is accomplished by manipulation of the exterior portion 40 of the locking arm 20'. It should be noted that the positioning of the exterior portion 40 significantly differs from that of the embodiment of FIGS. 1A and 1B in that the exterior portion 40 is located substantially on the interior of the earring assembly 10 in a visible and readily accessible location for manipulation thereof.

Figure 8A:
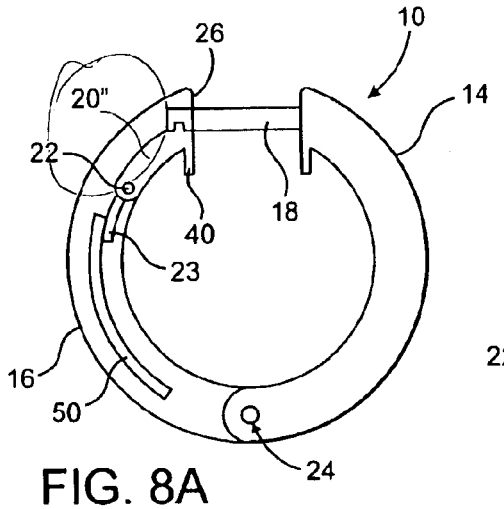
FIG. 8A is a yet another embodiment of the earring assembly of the present invention in a closed position.
Figure 8B:
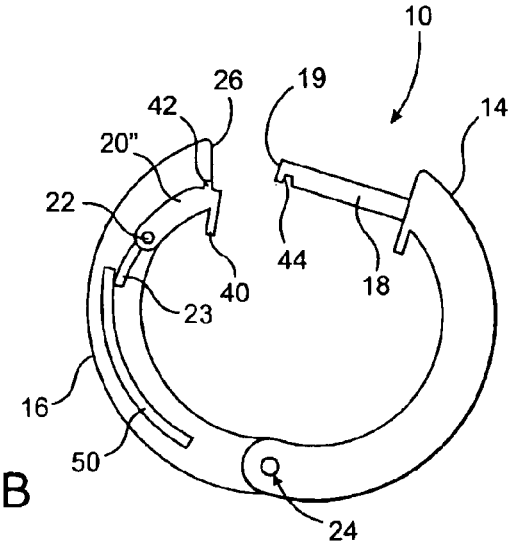
FIG. 8B is a schematic representation of the earring assembly of the embodiment of FIG. 8A in an open position.

The embodiment of FIGS. 8A and 8B comprises the earring assembly 10 including a clasp assembly 12 having a locking arm 20" movably connected to the earring segment 16 as at 22. In addition, the locking arm 20" includes an outwardly projecting extension 23 disposed in cooperative relation to the biasing structure or leaf spring 50, as with the previously described embodiments of FIGS. 5. The cooperative positioning and structuring of the leaf spring 50 and the extension portion 23 of the locking lever 20" serves to normally bias or maintain the locking arm 20" in the locked position of FIG. 8A. Orientation of the locking arm 20", out of the locked position and into an unlocked position is accomplished by exerting an appropriately directed force on the exterior portion 40 of the locking arm 20". In doing so, the locking arm 20" moves against the biasing force exerted on the extended portion 23.

Figure 9A:
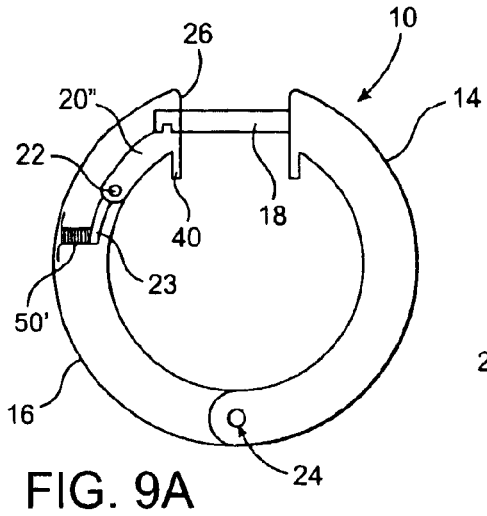
FIG. 9A is a schematic representation of yet another embodiment of the earring assembly of the present invention in a closed position.
Figure 9B:
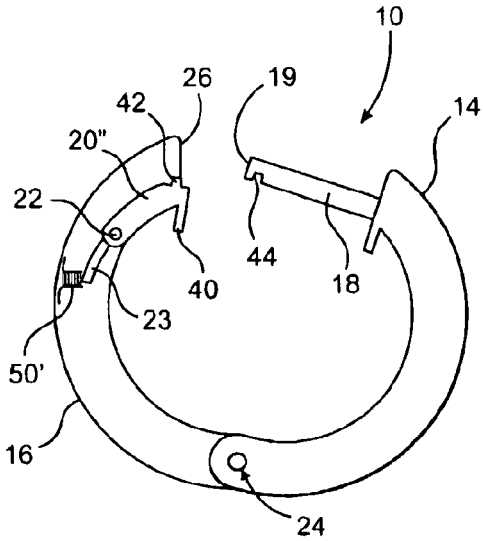
FIG. 9B is a schematic representation of the earring assembly of the embodiment of FIG. 9A in an open position.

Yet another embodiment on the earring assembly 10 is shown in FIGS. 9*a* and 9B. This embodiment is structurally and functionally similar to the embodiments of FIGS. 7A, 7B and BA, 8B with the exception of providing a biasing spring 50' having a coiled or other appropriate configuration. As with the embodiment of FIGS. 8A and 8B, orientation of the locking arm 20" from the locked position of FIG. 9A to the unlocked position of FIG. 9B is accomplished by exerting an appropriately directed force on the exterior portion 40.

Figure 10A:
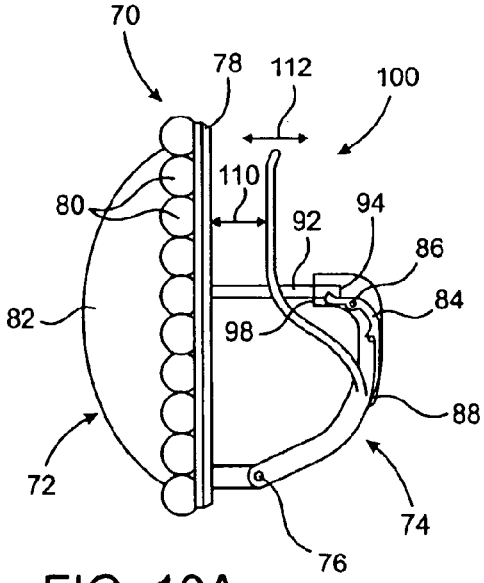
FIG. 10A is a schematic representation of yet another preferred embodiment of an earring assembly according to the present invention and illustrating a closed position.
Figure 10B:
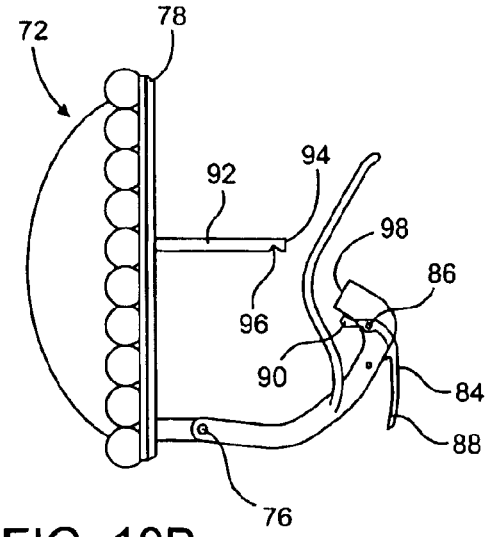
FIG. 10B is a schematic representation of the earring assembly of the embodiment of FIG. 10A illustrated in an open position.
Figure 10C:
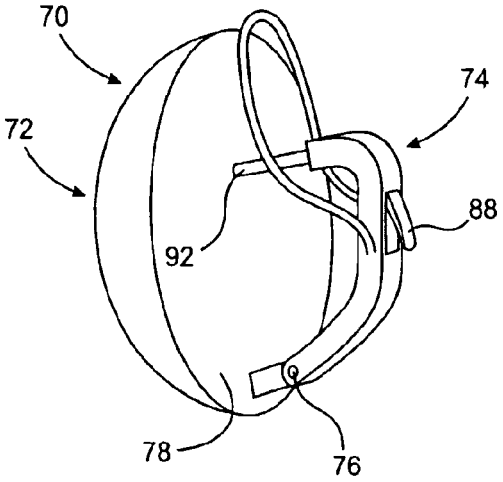
FIG. 10C is a schematic representation in a perspective view of the earring assembly of the embodiments of FIGS. 10A and 10B in a closed position.
Figure 10D:
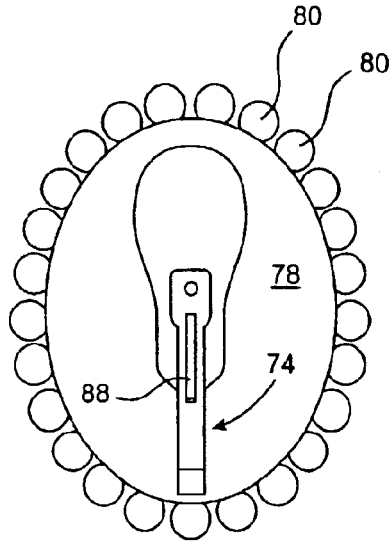
FIG. 10D is a schematic representation in a rear view of the earring assembly of FIGS. 10A, 10B and 10C in a closed position.

As set forth above, the earring assembly with which the clasp assembly 12 of the present invention may be used may vary in both size, configuration, style and appearance. By way of example, and to further emphasize the versatility of the present invention, the embodiment of FIGS. 10A through 10D have been included and illustrate another earring assembly, generally indicated as 70. This earring assembly 70 includes a first segment 72 and a second segment 74 movably connected to one another by a hinge or pivot structure 76. As is apparent, the first earring segment 72 includes a base 78 having one or more decorative components 80 and 82 mounted thereon and which may extend outwardly therefrom into a position which is clearly illustrated in FIGS. 10A and 10B. In contrast, the second earring segment 74 is more functional in nature and includes an interior portion in which a locking arm 84 is movably connected or mounted. As with previously described embodiments, the locking arm 84 may be movably or pivotally connected about member 86 such that it is positionable between the locked position of FIG. 10A and the unlocked position of FIG. 10B. Orientation of the locking arm 84 between the locked and unlocked positions occurs by manipulation of at least a portion 88 of the locking arm 84 located on the exterior of the earring segment 74.

In addition, the locking arm 84 includes a post engaging portion 90 disposable into locking engagement with a post 92 or at least a distal end 94 thereof. Also similar to the embodiment of FIGS. 1A and 1B, the post engaging portion 90 of the locking arm 84 may include at least one catch member or be otherwise configured to be received within at least one notch 96 formed within a portion of the post 92 adjacent the distal end 94, disposed on the interior of the earring segment 74 as clearly shown in FIG. 10A. Movement of the first and second earring segments 72 and 74 into the closed position of FIG. 10A from the open position of FIG. 10B serves to dispose the distal end 94 into the interior of the second earring segment 74 through an open end 98 thereof.

Another feature included within the embodiment of FIGS. 10A through 10D is the provision of a clip member generally indicated as 100. The clip member 100 is mounted on or connected to the earring segment 74 and movable therewith relative to the earring segment 72 and the post 92. The clip 100 preferably has an at least partially loop-type configuration and is disposable, when in the closed position of FIG. 10A, in at least partially surrounding relation to the post 92. When in the closed position of FIG. 10A, the clip structure 100 is disposed in spaced relation from the earring segment 72 and more specifically the base 78 thereof. As such, the spacing 110 between the base 78 and the clip 100 defines the area in which the earlobe of the wearer is disposed once the post 92 passes through the pierced portion of the earlobe of the wearer. Accordingly, structural and operational features of the embodiment of FIGS. 10A through 10D include clip member 100 being made of a sufficiently malleable or pliable material to allow it to be bent, deformed or otherwise oriented relative to the base 78 and into a "predetermined lobe engaging position".

Figure 12A:
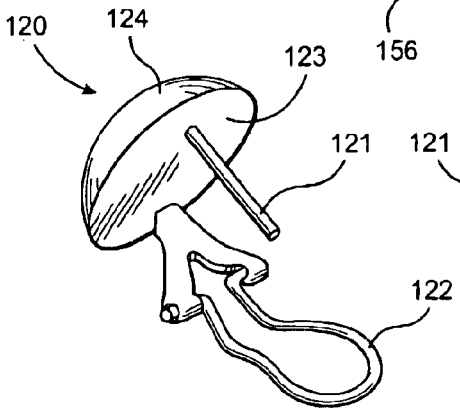
FIG. 12A PRIOR ART
FIG. 12A is a perspective view of another prior art earring assembly, different from that of FIG. 11, and depicted in an open position.
Figure 12B:
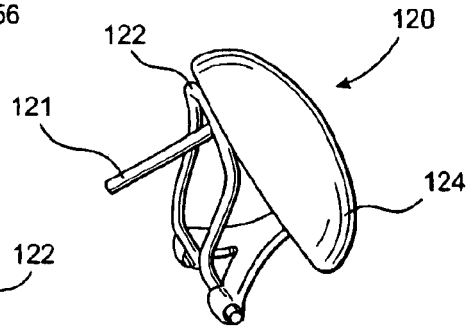
FIG. 12B PRIOR ART
FIG. 12B is a perspective view of the prior art embodiment of FIG. 12A but depicted in a closed position.

With reference to FIGS. 12A and 12B, a prior art earring structure 120 commonly employs a clip member 122 which is movably connected and selectively positionable between the open position of FIG. 12A and the closed position of FIG. 12B. However, once in the closed position of FIG. 12B the clip member is biased or otherwise forced into close proximity or actual engagement with the interior surface 123 of the exterior portion 124 of the earring structure 120. As such, it is common that a severe clamping force is exerted on the earlobe of the wearer as it is sandwiched between the clip 122 and the interior surface 123 of the earring 120. Disadvantages and problems associated with the prolonged wearing of the earring 122, in terms of discomfort to the wearer, has long been recognized.

Accordingly, in order to overcome the problems associated with the prior art structures of the type represented in FIGS. 12A and 12B, the clip member 10 is selectively adjustable into anyone of a variety of different spaced positions from the base 78. Therefore, the spacing or distance 110 between the clip member 100 and the base or interior surface thereof can be varied and adjustable by properly positioning the clip 100 relative to the surface 123 and thereby orienting the clip member 100 in a preferred lobe engaging position. Such an adjustable orienting or positioning of the clip member 100 may be accomplished by bending or otherwise deforming the clip member 100, due to the malleable material from which the clip member 100 is formed. The size of the space 110 is thereby determined in order to exert a sufficient, but not uncomfortable pressure, on the lobe which is positioned in the space 110 once the post 92 passes through the pierced portion of the earlobe of the wearer.

It is further emphasized that once bent or deformed into a predetermined lobe engaging position, as set forth above, the clip member 100 is not permanently disposed in such an adjusted position. To the contrary, the clip member 100 can again be bent, deformed or otherwise oriented to further vary the spacing or distance 110 and re-adjust the engaging pressure exerted by the clip member 100 on the earlobe of the wearer. The ability to initially and repeatedly adjustably position the clip member 100 and therefore regulate the size of the space 110 is intended to be schematically represented by the directional arrow 112.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An earring assembly structured to be removably secured to a wearer's earlobe, said earring assembly comprising:

a) at least two earring segments movably connected to one another and disposable between an open position and a closed position, b) a clasp assembly disposable into either a locked position or an unlocked position, c) said clasp assembly including a post connected to one of said two earring segments and a locking arm movably connected to the other of said two earring segments, d) said post dimensioned and structured to pass through a wearer's earlobe, e) said locking position defined by at least a portion of said post disposed on an interior of said other earring segment and said locking arm oriented in removable, locking engagement therewith, f) a locking member secured to said other earring segment and disposed to engage and removably maintain said locking arm in said locked position relative to said post, and g) said locking member fixedly secured on an interior of said other earring segment, said locking arm disposed into removable, frictional engagement with said locking member when oriented in said locked position.

2. An earring assembly as recited in claim 1 wherein a portion of said locking arm is disposed and configured to at least partially surround said locking member when said locking arm is in said locked position.

3. An earring assembly as recited in claim 1 further comprising a stop member secured to said other earring segment in engageable relation to said locking arm when in said locked position, said stop member disposed and structured to restrict movement of at least said locking arm out of said locked position.

4. An earring assembly as recited in claim 1 further comprising a stop member secured to said other earring segment in engageable relation to said locking arm when in said locked position, said stop member disposed and structured to restrict movement of said locking arm out of locking engagement with said post.

5. An earring assembly as recited in claim 4 wherein said exterior portion is disposed on an exterior of said other segment in a visually observable and physically accessible location, said exterior portion manually disposable to orient said locking arm into and out of said locked and unlocked positions.

6. An earring assembly as recited in claim 5 wherein said locking arm further comprises an interior portion movable on an interior of said other earring segment into and out of said locked and unlocked positions.

7. An earring assembly as recited in claim 6 wherein said locking arm includes a post engaging portion connected to said interior portion and movable therewith on the interior of said other earring segments into and out of said locking engagement with said post.

8. An earring assembly structured to be removably secured to a wearer's earlobe, said earring assembly comprising:

a) two earring segments movably connected to one another and selectively disposable into and out of either a closed position or an open position, b) a clasp assembly comprising a post and a locking arm, said post dimensioned and structured to pass through the wearer's earlobe and said locking arm including a post engaging portion, c) said post connected to one of said two earring segments and extending outwardly therefrom and said locking arm movably connected to the other of said two earring segments, d) said clasp assembly removably disposed into a locked position at least partially defined by said post engaging portion oriented into locking engagement with said post on an interior of said other segment, e) said locking arm including an exterior portion disposed on an exterior of said other earring segment and being accessible to orient said locking arm into and out of said locked position, and f) a locking member fixedly secured to said other earring segment, said locking arm disposed into removable, frictional engagement with said locking member when said locking arm is oriented in said locked position.

9. An earring assembly as recited in claim 8 further comprising a stop member secured to said other earring segment in engageable relation to said locking arm when in said locked position, said stop member disposed and structured to restrict movement of said locking arm out of said locking engagement with said post.

10. An earring assembly as recited in claim 8 wherein said exterior portion is disposed on an exterior of said other segment in a visually observable and physically accessible location, said exterior portion fixedly secured to a remainder of said locking arm and manually positionable to orient said locking arm into and out of said locking engagement with said post.

11. An earring assembly as recited in claim 8 wherein said clasp assembly further comprises at least one notch formed in said post and at least one catch member disposed within the interior of said other earring segment, said locked position at least partially defined by said one catch member removably disposed within said one notch.

12. An earring assembly as recited in claim 11 wherein said catch member is secured to said locking arm and movable therewith into and out of said notch.

13. An earring assembly as recited in claim 11 wherein said locked position is further defined by said locking arm orienting and maintaining said notch into receiving engagement with said catch member when said locking arm is disposed in locking engagement with said post.

14. An earring assembly structured to be removably secured to a wearer's earlobe, said earring assembly comprising:

a) at least, two earring segments movably connected to one another and disposable between an open position and a closed position, b) a clasp assembly disposable into either a locked position or an unlocked position, c) said clasp assembly including a post connected to one of said two earring segments and a locking arm movably connected to the other of said two earring segments, d) said post dimensioned and structured to pass through a wearer's earlobe, e) said locking position defined by at least a portion of said post disposed on an interior of said other earring segment and said locking arm oriented in removable, locking engagement therewith, f) said post comprising a distal end disposed within the interior of said other segment when said earring segments are in said closed position; said locking arm comprising a post engaging portion disposable into said locking engagement with said post, and g) said clasp assembly further comprising at least one notch formed in said post substantially adjacent to said distal end and at least one catch member secured directly to said earring segment within the interior thereof independently of said locking arm, said locked position at least partially defined by said catch member removably disposed within said notch.

15. An earring assembly as recited in claim 14 wherein said locked position is further defined by said locking arm orienting and maintaining said post and said notch into receiving engagement with said catch member when said locking arm is disposed in said locking engagement with said post.

16. An earring assembly as recited in claim 15 wherein said locking engagement between said locking arm and said post is disposed in spaced, substantially opposing relation to said receiving engagement between said notch and said catch member.

17. An earring assembly structured to be removably secured to a wearer's earlobe, said earring assembly comprising:

a) at least two earring segments movably connected to one another and disposable between an open position and a closed position, b) a clasp assembly disposable into either a locked position or an unlocked position, c) said clasp assembly including a post connected to one of said two earring segments and a locking arm movably connected to the other of said two earring segments, d) said post dimensioned and structured to pass through a wearer's earlobe, e) said locking position defined by at least a portion of said post disposed on an interior of said other earring segment and said locking arm oriented in removable, locking engagement therewith, and f) said clasp assembly further comprising a plurality of notches formed on a portion of said post disposed within said other segment and a plurality of catch members disposed on the interior of said other segment, said locked position at least partially defined by said plurality of catch members removably received within correspondingly positioned ones of said plurality of notches.

18. An earring assembly as recited in claim 17 wherein a first of said plurality of catch members is secured to said locking arm and movable therewith into and out of engagement with a corresponding one of said plurality of notches.

19. An earring assembly as recited in claim 18 wherein a second of said plurality of catch members is secured to said other earring segment independent of said locking arm and in engaging relation to a corresponding one of said plurality of notches.

20. An earring assembly as recited in claim 19 wherein said locked position is further defined by said locking arm orienting and maintaining corresponding ones of said plurality of notches into receiving engagement with said first and second catch members when said locking arm is disposed in locking engagement with said post.

21. An earring assembly structured to be removably secured to a wearer's earlobe, said earring assembly comprising:

a) two earring segments movably connected to one another and selectively disposable into and out of either a closed position or an open position, b) a clasp assembly comprising a post and a locking arm, said post dimensioned and structured to pass through the wearer's earlobe and said locking arm including a post engaging portion, c) said post connected to one of said two earring segments and extending outwardly therefrom and said locking arm movably connected to the other of said two earring segments, d) said clasp assembly removably disposed into a locked position at least partially defined by said post engaging portion oriented into locking engagement with said post on an interior of said other segment, e) said locking arm including an exterior portion disposed on an exterior of said other earring segment and being accessible to orient said locking arm into and out of said locked position, and f) said clasp assembly further comprising a plurality of notches formed on a portion of said post disposed within said other earring segment and a plurality of catch members disposed on the interior of said other earring segment, said locked position at least partially defined by said plurality of catch members removably received within correspondingly positioned ones of said plurality of notches.

22. An earring assembly as recited in claim 21 wherein a first of said plurality of catch members is secured to said locking arm and movable therewith into and out of engagement with a corresponding one of said plurality of notches; a second of said plurality of catch members being directly secured to said other earring segment independent of said locking arm and in engaging relation to a corresponding one of said plurality of notches.

* * * * *